US005692701A

United States Patent [19]

Holliday

[11] Patent Number: 5,692,701

[45] Date of Patent: Dec. 2, 1997

[54] KNOCK DOWN REEL HOLDER

[76] Inventor: Larry R. Holliday, 2524 SE. 31st Ave., Portland, Oreg. 97202

[21] Appl. No.: 676,792

[22] Filed: Jul. 8, 1996

[51] Int. Cl.[6] ..... B65H 75/22

[52] U.S. Cl. ..... 242/598.5

[58] Field of Search ..... 242/598.3, 598.5, 242/599.3; 248/230.1

[56] References Cited

U.S. PATENT DOCUMENTS

| | | | |
|---|---|---|---|
| D. 286,493 | 11/1986 | Floyd . | |
| 1,239,082 | 9/1917 | Cary | 242/594.3 |
| 1,502,518 | 7/1924 | Nasta | 242/598.5 |
| 1,509,717 | 9/1924 | Davis . | |
| 2,250,367 | 7/1941 | Gilbert . | |
| 3,262,649 | 7/1966 | Beam . | |
| 3,325,120 | 6/1967 | Brinkman | 242/598.5 |
| 4,328,930 | 5/1982 | Kalendovsky . | |
| 4,932,601 | 6/1990 | Arrington . | |

*Primary Examiner*—John P. Darling
*Attorney, Agent, or Firm*—Eugene M. Eckelman

[57] ABSTRACT

Leg brackets for the reel holder have a bore between the side surfaces of its body portion. The bores are capable of receiving existing conduit which is combined with the leg brackets to form a holder for wire reels. The body portion has upwardly angled leg sockets extending in from each end and capable of receiving legs that support the body portion in a reel holding position. These legs can also be formed of existing conduit. A full width bottom slot is provided in the body portion which is combined with a cinching bolt at a lower portion of the body portion in the area of the slot. The cinching bolt when tightened being arranged to move the sides of the slot toward each other to bind the legs in their sockets. When the cinching bolt is released, the legs can be released from the body portion for disassembly of the holder.

4 Claims, 1 Drawing Sheet

KNOCK DOWN REEL HOLDER

BACKGROUND OF THE INVENTION

This invention relates to new and useful improvements in a reel holder and in particular is concerned with a knock-down reel holder.

Various types of wire are supplied on reels. Electrical wiring is an example. In buildings that are being wired, steel conduit generally comprises the protection for the wire which is threaded therethrough. Reels for such wire are usually placed loosely on the floor when the electrician is threading the wire through the conduit and such creates disadvantages because as the wire is stripped from the reels, the reels tumble or roll around the floor. They thus get in the way and also can damage surrounding areas. Also, the wire on the reels can be damaged. Although reel holders such as shown in U.S. Pat. No. 1,509,717 have been known, these reels are bulky to use and store. They are also complicated in structure. Therefore, holders of this type usually comprise an additional piece of equipment for a workman and their use is resisted by the workmen. Further yet, carts for the wire reels are not always available or will not accommodate the quantity or physical size of the reels.

SUMMARY OF THE INVENTION

According to the invention, it is an object to provide a simplified reel holder and particularly a reel holder that is readily assembled and disassembled in the field and furthermore to provide a reel holder utilizing a novel leg bracket that allows assembly of the holder in the field using leg and shaft portions that can be constructed from scrap metal conduit of the type that is used in construction projects to protect wire strung therethrough. It is another object to provide a reel holder that can be adapted to accommodate the quantity and size of reels.

According to the invention, a leg bracket is provided which when combined with one or more other similar leg brackets can form a reel holder that uses conventional and available tubular conduit as a shaft and as the legs. The leg brackets have a bore extending therethrough which is located adjacent the upper portion of the bracket. These bores are capable of receiving a cross shaft for supporting reels, and the brackets have upwardly angled leg sockets that lead inwardly from end edges thereof and are capable of freely receiving legs that support the leg brackets in a reel holding position. The leg brackets have bottom slot means that extend fully from end to end and upwardly into the leg sockets to form a bifurcated wall structure. In a normal condition of the bifurcated wall structure, the legs can be inserted freely into the bottom opening sockets, and cinching means are provided at a lower portion of the brackets to spring the bifurcated walls together against the legs for frictionally and temporarily securing the legs in the sockets. The leg sockets and shaft receiving bore are sized for receiving tubular conduit, for example, ½ inch EMT electrical metallic tubing, which as known, is quite common on constructions jobs and always available on electrical service trucks. Special size sockets may be used if necessary.

The invention will be better understood and additional objects and advantages will become apparent from the following description taken in connection with the accompanying drawings.

DETAILED DESCRIPTION OF A PREFERRED EMBODIMENT

Figure 1:
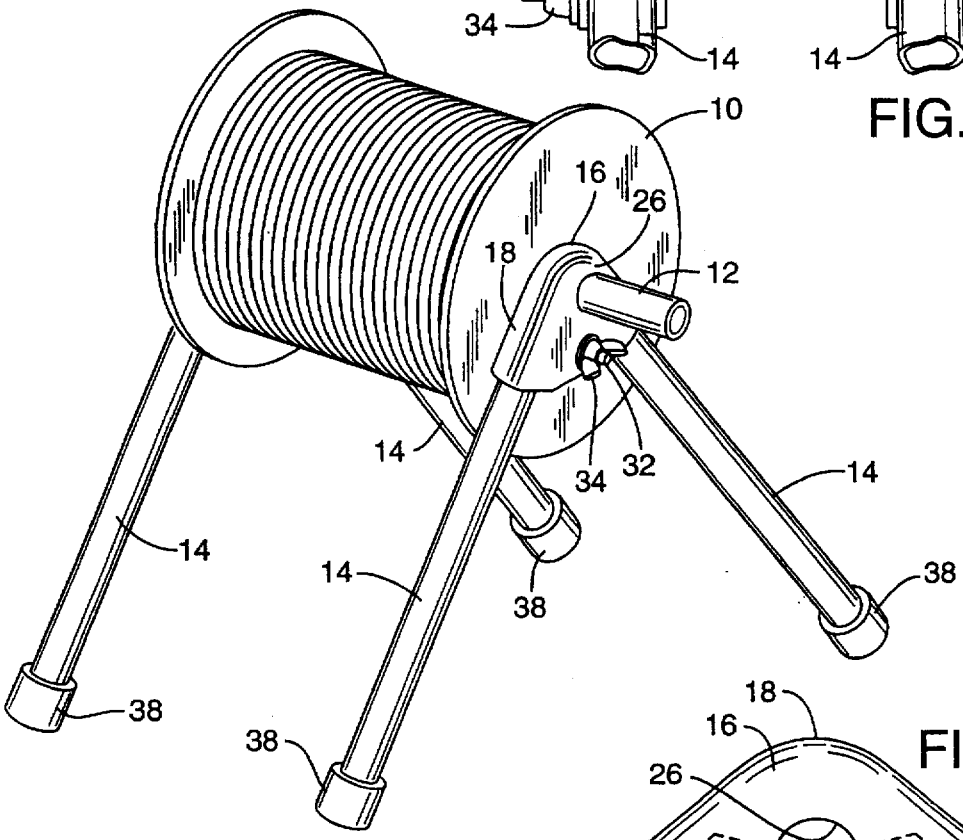
FIG. 1 is a perspective view of an assembled reel holder embodying features of the present invention.

FIG. 1 shows the function of the present invention, namely, to provide a support for a reel 10 of wire that facilitates easy unwinding of the wire. As stated above, one important function of the present reel holder is that it has a design making it efficient in its usage with building construction wherein a shaft 12 and legs 14 can comprise conduit of the type that is used to protect wire in a building. Importantly, and as will be seen hereafter, scrap conduit of this type is usually available at the building site, with the advantage that the holder can be assembled at the site and the shaft and leg portions do not have to be carried in the tool box. When the job is done, the reel support can be knocked down.

The reel holder comprises leg brackets 16 having a peaked top edge 18 and a straight bottom edge 20. The opposite sides of top edge 18 extend down at equal angles. The outer ends of the top edge portions terminate at end walls 22 that extend downwardly at an angle, for example a right angle, from their top edge portions for juncture with the bottom edge 20.

Bracket 16 has a bore 26 through it in its upper portion. This bore is arranged to freely receive the shaft 12 for easy assembly and disassembly of the holder. Extending inwardly through the end edges 22 are leg sockets 28. These leg sockets angle at approximately 100° from each other. This angular relation has been found to provide the best front to rear stability. Sockets 28, similar to the bore 26, are of a diameter for receiving metal conduit generally used for wiring in construction of buildings.

A slot 30 extends up from the bottom edge 20 to and into the leg sockets 28, thus forming a bifurcated wall structure of the brackets. Slot 30 in the central portion of the bracket terminates short of the bore 26 so that a central reinforcing portion **16*a* remains around the bore. The lower portion of the bracket has a carriage cross bolt 32 therein which has a securing nut 34. Leg bracket 16 is of a structure, such as plastic, metal or other material that will allow the cross bolt 32** to force the opposite wall portions together when the nut is tightened but to spring apart when the bolt is loosened. The sockets are thus sized for freely receiving the leg but the dimensions are also such that the bifurcated wall portions can be up against the legs for frictionally holding them in place when the nut is tightened.

Figure 4:
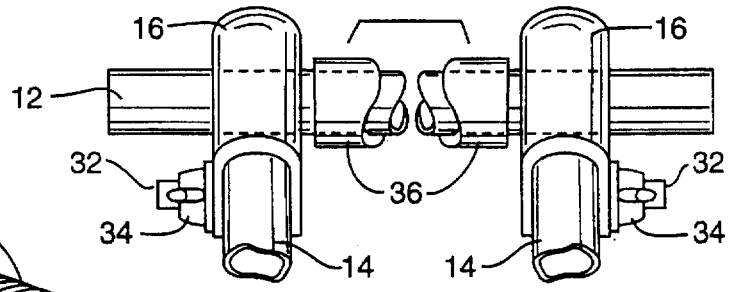
FIG. 4 is a fragmentary, foreshortened elevational view showing an assembly of the invention with a shaft reinforcement for supporting a heavier than normal reel.
Figure 2:
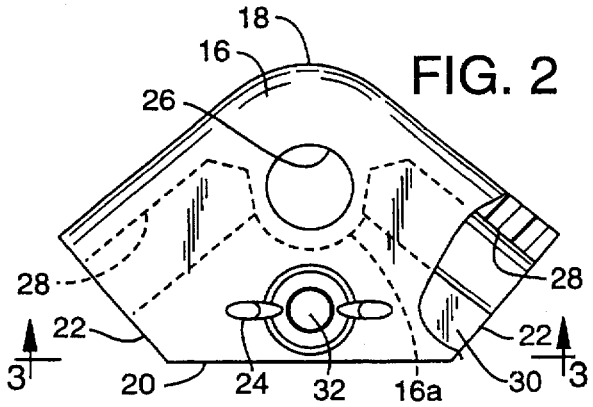
FIG. 2 is a side elevational view of a leg bracket of the invention.
Figure 3:
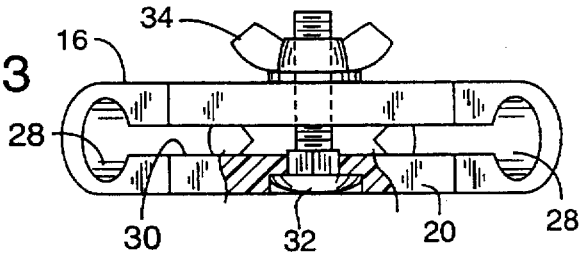
FIG. 3 is a bottom plan view of one of the leg brackets, as viewed in the direction of the arrows 3—3 in FIG. 2.

Thus, in forming a reel holder, legs of suitable length are installed in the bracket sockets 28 after first loosening the nuts 34. Upon tightening of the nuts, the legs are secured in place, thus completing assembly of the leg brackets. Thereupon, one or more reels may be slid onto a piece of conduit that will serve as the shaft 12. This assembly of shaft and reels then can be combined with the leg brackets to provide a completed loaded reel stand which allows wire to be unrolled in an expeditious manner. It is not necessary that the shaft be secured to the leg brackets since the size tolerances are such that the brackets will stand upright or only tilt very slightly. More than two leg brackets can be used if desired, particularly when multiple reels are being supported. For supporting multiple, heavy or wide reels, a steel sleeve 36 or the like, FIG. 4, can be placed on the shaft conduit for reinforcement.

As was noted, the shaft and legs can comprise conduit that is used on the construction site. Such conduit is usually available in scrap form on the job and is easily cut to length at the site, whereby the electrician does not have to pack the legs and shaft around in his tool box. The extent of the reel structure for transportation and storage can thus simply be the leg brackets 16. If desired, elastomeric bottom cups 38 can be provided on the legs if there is the possibility that the bottom of the legs may scratch the floor. The heads of carriage bolts 32 include a square or otherwise non-round section receivable in a correspondingly non-round opening in the lower portion of bracket 16 to provide a tool-less tightening and untightening of the legs. Further, the connections for the legs facilitates use on uneven ground such as outdoors, mud, grass, gravel, etc.

It is to be understood that the form of my invention herein shown and described is to be taken as a preferred example of the same and that various changes in the shape, size and arrangement of parts may be resorted to. For example, the holder may be used to support reels or spools of rubber hose, tape, stickers, ribbon, and the like. This and other changes may be made without departing from the spirit of my invention, or the scope of the subjoined claims.

Having thus described my invention, I claim:

1. A knock-down reel holder comprising:

a leg bracket, said leg bracket having a body portion with opposite side surfaces, top and bottom edges and end edges, a bore extending through said body portion between said side surfaces and disposed adjacent an upper portion of said body portion, said bore in at least two of said body portions being capable of freely and removably receiving a reel supporting shaft for supporting at least one reel of wire and like elongated flexible materials between the body portions, upwardly angled leg sockets in said body portion leading inwardly from said end edges and capable of freely receiving legs that support said body portions in a reel holding position, and leg securing means on said body portion releasably securing said legs in said leg sockets.

2. The reel holder of claim 1 including bottom slot means extending fully from end to end of said body portion and upwardly into said leg sockets forming a bifurcated wall structure, said leg securing means including cinching means extending across said slot, said cinching means having a release position with said bifurcated wall structure that allows normal slot spacing of said bifurcated wall structure for insertion or removal of the legs relative to said leg socket and having a cinching position that springs the bifurcated wall structure together against the legs in said sockets for frictionally securing the legs in said sockets.

3. The reel holder of claim 2 wherein said cinching means comprises a threaded fastener.

4. A leg bracket for knock-down reel holders capable of using tubular conduit as a reel shaft and also as legs for the holder, said bracket comprising:

a body portion having opposite side surfaces, top and bottom edges and end edges, a bore extending through said body portion between said side surfaces and disposed adjacent an upper portion of said body portion, said bore in a pair of said body portions being capable of freely and removably receiving a reel supporting shaft for supporting at least one reel of wire and the like between the body portions, upwardly angled leg sockets in said body portion leading inwardly from said end edges and capable of freely receiving legs that support said body portions in a reel holding position, and leg securing means on said body portion releasably securing said legs in said leg sockets.

* * * * *